US007950650B2

(12) United States Patent
Koyanagi

(10) Patent No.: US 7,950,650 B2
(45) Date of Patent: May 31, 2011

(54) FEEDING DEVICE AND RECORDING APPARATUS

(75) Inventor: Noriyuki Koyanagi, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 97 days.

(21) Appl. No.: 12/358,847

(22) Filed: Jan. 23, 2009

(65) Prior Publication Data

US 2009/0189341 A1 Jul. 30, 2009

(30) Foreign Application Priority Data

Jan. 24, 2008 (JP) ..... 2008-013428

(51) Int. Cl.
*B65H 1/00* (2006.01)

(52) U.S. Cl. ..... 271/161; 271/171

(58) Field of Classification Search ..... 271/161, 271/171

See application file for complete search history.

(56) References Cited

U.S. PATENT DOCUMENTS 4,349,186 A * 9/1982 Nakamura ..... 271/18
4,619,450 A * 10/1986 Anderson et al. ..... 271/35

FOREIGN PATENT DOCUMENTS

| | | |
|---|---|---|
| JP | 11-199063 | 7/1999 |
| JP | 2001-031256 | 2/2001 |
| JP | 2002-128286 | 5/2002 |
| JP | 2005-035684 | 2/2005 |
| JP | 2007-153532 | 6/2007 |

* cited by examiner

*Primary Examiner* — Michael C McCullough
(74) *Attorney, Agent, or Firm* — Maschoff Gilmore & Israelsen

(57) ABSTRACT

A feeding device includes a mounting portion which mounts media thereon, a feeding roller which feeds the mounted media, an edge-guide which moves in a widthwise direction of the mounted media which traverses a feeding direction of the mounted media and aligns both sides of the mounted media, and a curve-imparting portion which imparts a curve to the mounted media in a direction which intersects a moving direction of the edge-guide.

7 Claims, 17 Drawing Sheets

FEEDING DEVICE AND RECORDING APPARATUS

BACKGROUND

1. Technical Field

The present invention relates to a feeding device having a mounting portion which mounts media thereon, a feeding roller which feeds the mounted media, and an edge-guide which moves in a widthwise direction of the media which traverses a feeding direction of the mounted media and aligns both sides of the mounted media, and a recording apparatus having the feeding device. In this specification, examples of the recording apparatus include an ink jet printer, a wire dot printer, a laser printer, a line printer, a copier, a facsimile, etc.

2. Related Art

In the past, as disclosed in JP-A-2002-128286, a recording apparatus included a feeding roller which feeds paper and a hopper which can approach and depart from the feeding roller and on which the paper is mounted. A pair of edge-guides for guiding the paper in the widthwise direction of the paper is disposed in the hopper in a manner such that the edge-guides slide in the widthwise direction. Accordingly, when setting the paper, a user broadens the width of the edge-guides by moving the edge-guides in the widthwise direction first, and then mounts the paper on the hopper. Subsequently, the user aligns both side ends of the paper by causing the edge-guides to slide in a narrowing direction of the edge-guides. As a result, it is possible to feed the paper in a stable posture of the paper.

However, when the edge-guides slide to predetermined positions, in the case in which stiffness of the paper mounted in the hopper is relatively weak, the paper is pushed inward by the edge guides and therefore there is a possibility that a middle portion of the paper in the widthwise direction curves as if it floats up. In other words, the edge guides are positioned to be spaced apart from each other by a distance which is smaller than the width of the paper, and therefore the paper is likely to curve in the widthwise direction. In such a case, there is a possibility that the paper cannot be placed at a predetermined position. When feeding the paper, back tension which is frictional force between side ends of the paper and the edge guides increases.

In the case in which the number of paper sheets mounted in the hopper is small, for example, 1 to 3, the paper is also likely to curve in the widthwise direction.

That is, since the stiffness of the mounted paper is weak, there is the possibility that it is impossible to align both side ends of the paper with high precision. In such a case, positions of the paper sheets in the widthwise direction vary and therefore there is a possibility that recording positions with respect to the paper sheets vary. As a result, there is a possibility that it is impossible to perform good recording.

SUMMARY

An advantage of some aspects of the invention is that it provides a feeding device which can surely align both side ends of media even in the case in which stiffness of the media is weak, and a recording apparatus including the feeding device.

According to a first aspect of the invention, there is provided a feeding device including a mounting portion which mounts media thereon, a feeding roller which feeds the mounted media, an edge guide which moves in a widthwise direction of the mounted media which traverses a feeding direction of the mounted media, and a curve-imparting portion which imparts a curve to the mounted media in a direction which intersects a moving direction of the edge guide.

According to the first aspect, the feeding device includes the curve-imparting portion. Accordingly, it is possible to curve the mounted media in the direction which intersects the moving direction of the edge guide. Further, it is possible to remarkably increase the stiffness of the mounted media in the widthwise direction of the media by curving the mounted media. As a result, when aligning both sides of the media by pushing both sides of the media with the edge guide, there is no possibility that bulking of the media occurs. Further, it is possible to surely align both ends of the media.

This advantage is particularly effective in the case in which the number of the mounted media is small and in the case in which stiffness of the media is relatively weak. That is, even if the number of media is small, the edge guide can align the media by pushing both sides of the media with the force as strong as the force in the case in which the number of media is large since the stiffness is dramatically increased. In a similar manner, even if the stiffness of the media is relatively weak, it is possible to align the media by pushing both ends of the media with the force as strong as in the case in which the stiffness of the media is relatively strong.

"The direction which intersects the moving direction of the edge guide" means most preferably a direction which perpendicularly intersects the moving direction of the edge guide.

According to a second aspect, in the feeding device of the first aspect, it is preferable that the edge guide is automatically moved by driving of a motor.

According to the second aspect, in addition to the same advantage of operation of the feeding device of the first aspect, the edge guide has a structure in which it is automatically moved by the driving of the motor. For example, it is structured in a manner such that as a control portion compares a current value of the motor with a predetermined threshold value, the driving of the motor is stopped when the current value exceeds the predetermined threshold value. In such a case, it is possible to increase the degree of freedom in setting of the predetermined threshold value by imparting the curve to the media by the curve-imparting portion. In greater detail, there is no need to largely change the predetermined threshold value according to the number of the mounted media or the stiffness of the media.

When it is explained in further detail, if the media do not have the curve when the number of the media is small, as both ends of the media are pushed with the pushing force as strong as in the case of the large number of the media, there is a possibility that the media bulk. Accordingly, it can be considered that the predetermined threshold value is changed to a smaller value in order to decrease the pushing force. However, since the media have the curve in this invention, there is no possibility that the media bulk. Accordingly, there is no need to change the predetermined threshold value.

In a similar manner with the case in which the stiffness of the media is weak, in the case in which the media do not have the curve, if both ends of the media are pushed with the pushing force as strong as in the case of the strong stiffness, there is a possibility that the media bulk. Accordingly, it can be considered that the predetermined threshold value is changed to a smaller value in order to decrease the pushing force. However, in the invention, since the media have the curve, there is no possibility that the media bulk. Accordingly, there is no need to change the predetermined threshold value.

According to a third aspect, in the feeding device of the second aspect, it is preferable that when at least the edge guide aligns the media by movement thereof, the curve be imparted to the media by the curve-imparting portion; and when the media are fed by the feeding roller, the curve attributable to the curve-imparting portion be released.

According to the third aspect, in addition to the same advantage of operation of the feeding device of the second aspect, when at least the edge guide aligns the media by movement thereof, the curve is imparted to the media by the curve-imparting portion. Accordingly, it is possible to surely align both ends of the media. Further, when the media are fed by the feeding roller, the curve of the media which is attributable to the curve-imparting portion is released. Accordingly, there is no possibility that the curve-imparting portion has the back tension with respect to the media which is fed.

According to a fourth aspect, in the feeding device of the third aspect, it is preferable that the curve-imparting portion interlock with movement of the edge guide.

According to the fourth aspect, in addition to the advantage of operation of the feeding device of the third aspect, the curve-imparting portion is interlocked with movement of the edge guide. Accordingly, only when both ends of the media are aligned, it is possible to make the curve-imparting portion effective.

According to a fifth aspect, in the feeding device of any of the first to fourth aspects, it is preferable that the curve-imparting portion include an opening extending in the widthwise direction at a portion of the mounting portion, and an urging portion which can urge the mounted media in a direction from the upper side to the lower side of the stacked media at a position which faces the opening.

According to the fifth aspect, in addition to the advantage of operation of the feeding device of any of the first to fourth aspects, the curve-imparting portion includes the opening extending in the widthwise direction at a portion of the mounting portion and the urging portion which urges the mounted media in a direction from the upper side to the lower side of the stacked media. Accordingly, it is possible to easily form the curve-imparting portion.

According to a sixth aspect, in the feeding device of any of the first to third aspects, it is preferable that the curve-imparting portion be disposed at an inner side of the edge guide in a movable manner along with movement of the edge guide and include a moving portion which is movable in a stacking direction of the media at a position which faces the neighborhood of an upstream end in the feeding direction of the mounting portion and an urging unit which urges the moving portion toward the mounting portion, in which the moving portion has a tapered portion which is disposed at an inner side of the moving portion and which tapers upward in the stacking direction of the media as it directs inward, traversing the moving direction of the edge guide.

According to the sixth aspect, in addition to the advantage of operation of the feeding device of any of the first to third aspects, the curve-imparting portion includes the moving portion which is disposed at an inner side of the edge guide in the integrally movable manner along with movement of the edge guide and which is movable in the stacking direction of the medium at the position which faces the neighborhood of the upstream end in the feeding direction of the mounting portion, and the urging unit which urges the moving portion toward the mounting portion, in which the moving portion has the tapered portion which is disposed at an inner side of the moving portion and tapers upward in the stacking direction of the media as it directs inward, traversing to the moving direction of the edge guide.

According to a seventh aspect, in the feeding device of any of the first to fourth aspects, it is preferable that the mounting portion includes a hopper which can approach and depart from the feeding roller and a medium support portion disposed at an upstream side in the feeding direction by virtue of the hopper, in which the curve-imparting portion imparts a curve to the media by displacing a posture of a medium support portion so as to face a posture of a hopper.

According to the seventh aspect of the invention, in addition to the advantage of operation of the feeding device of any of the first to fourth aspects, the mounting portion includes the hopper which can approach and depart from the feeding roller and the medium support portion disposed at the upstream side in the feeding direction by the hoper, in which the curve-imparting portion imparts a curve to the media by displacing the posture of the medium support portion so as to face the posture of the hopper. Accordingly, it is possible to easily form the curve-imparting portion.

According to an eighth aspect of the invention, there is provided a recording apparatus including a feeding portion which feeds a recording object which is mounted and a recording portion which performs a recording on the recording object fed from the feeding portion by a recording head, in which the feeding portion includes the feeding device of any of the first to seventh aspects.

According to the eighth aspect of the invention, the feeding portion includes the feeding device according to any of the first to seventh aspects. Accordingly, in the recording apparatus, it is possible to obtain the same advantage of operation of the feeding device of any of the first to seventh aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

Figure 1:
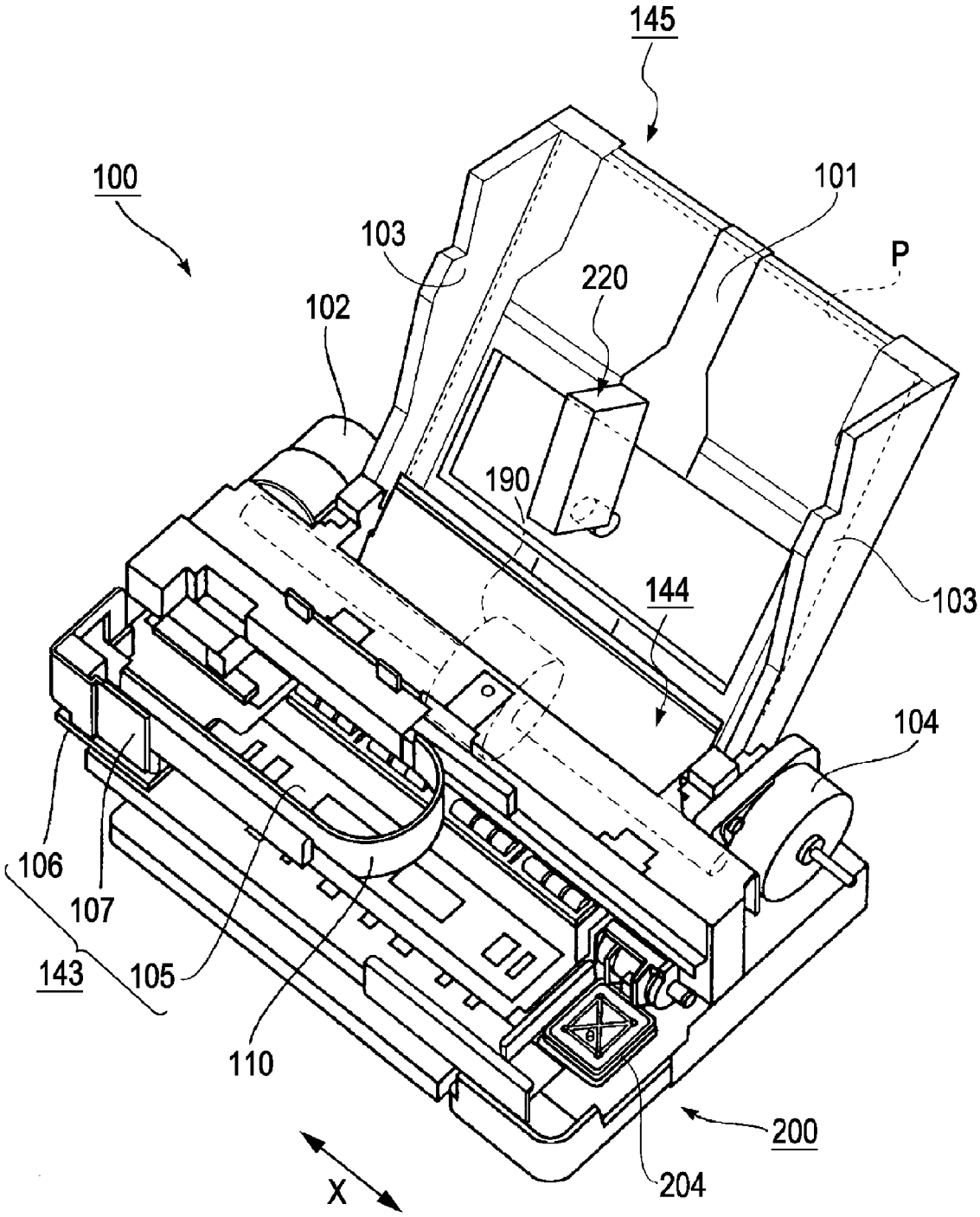
FIG. 1 is an overall perspective view illustrating a simple overview of a recording apparatus according to the invention.

FIG. 1 is an overall perspective view illustrating a simple overview of a recording apparatus which is an example of a liquid ejection apparatus according to the invention.

Here, the term "liquid ejection apparatus" is not limited to an ink jet recording apparatus which performs a recording on a recording object by ejecting ink to the recording object, such as recording paper, from a recording head serving as a liquid ejection head and a recording apparatus, such as copier and facsimile, but is used to mean a structure including an apparatus which ejects liquid having a specific use instead of ink to an ejection object corresponding to the recording object from a liquid ejection head corresponding to the recording head and therefore attach the liquid to the ejection object.

Further, in addition to the recording head, examples of the liquid ejection head include a color material ejection head used in manufacture of a color filter of a liquid crystal display, an electrode material (conductive paste) ejection head used in formation of an electrode of an organic EL display or a surface light-emitting display (FED), a bio-organic material ejection head used in manufacture of a biochip, and a sample ejection head for ejecting a sample, which serves as a precision pipette.

At the back side of a main body of a recording head 100, a mounting portion 145, in which paper P serving as a recording medium is mounted and stacked, and a hopper 101 serving as a feeding portion 144 are disposed in a manner of being capable of approaching and departing from a feeding roller 190 of the feeding portion 144 which will be described below. In greater detail, the hopper 101 is disposed in a manner such that it can swing about a pair of hopper spindles 304 and 304 (see FIGS. 3 to 8) disposed at an upper portion of the hopper 101. The paper P mounted at the uppermost position of the hopper 101 is fed to the recording portion side which is a downstream side of a feeding direction by the feeding portion 144.

In greater detail, the mounted paper P is guided by left and right edge guides 103 and 103 and fed by a feeding roller 190 driven by a feeding motor 104 to a transporting roller pair (not shown) at a downstream side of the feeding direction. The paper P fed to the transporting roller pair is further transported to a recording portion 143 at a downstream side of a transporting direction by transporting drive rollers (not shown) of the transporting roller pair driven by transporting motors (not shown).

The recording portion 143 is composed of a platen 105 supporting the paper P from the underside and a carriage 107 disposed so as to face a position above the platen 105. Of these elements, the carriage 107 is guided by a carriage guide shaft (not shown) extending in a primary scan direction, which is a widthwise direction X of the transported paper P, and driven by a carriage motor 102. Further, a recording head 106 discharging ink toward the paper P is disposed at a bottom surface portion of the carriage 107. The paper P which passed through recording processing in the recording portion 143 is transported to the downstream side and discharged from the front side of the recording apparatus 100 by a discharge roller (not shown).

The ink cartridge (not shown) is loaded under the main body of the recording apparatus 100, and ink is supplied to an ink supply path (not shown) via an ink supply needle (not shown). Further, ink is supplied to the recording head 106 of the carriage 107 via an ink supply tube 110. When flushing and cleaning the recording head 106, the ink cartridge is disposed at a first digit side and a discharge-suction operation of ink is performed in an ink suction device 200 serving as a discharge characteristic maintaining portion which maintains a discharge characteristic of the recording portion 143. The ink suction device 200 includes a cap portion 204, and is structured in a manner of being capable of sealing the recording head 106 by moving the cap portion 204 in a vertical direction.

Figure 2:
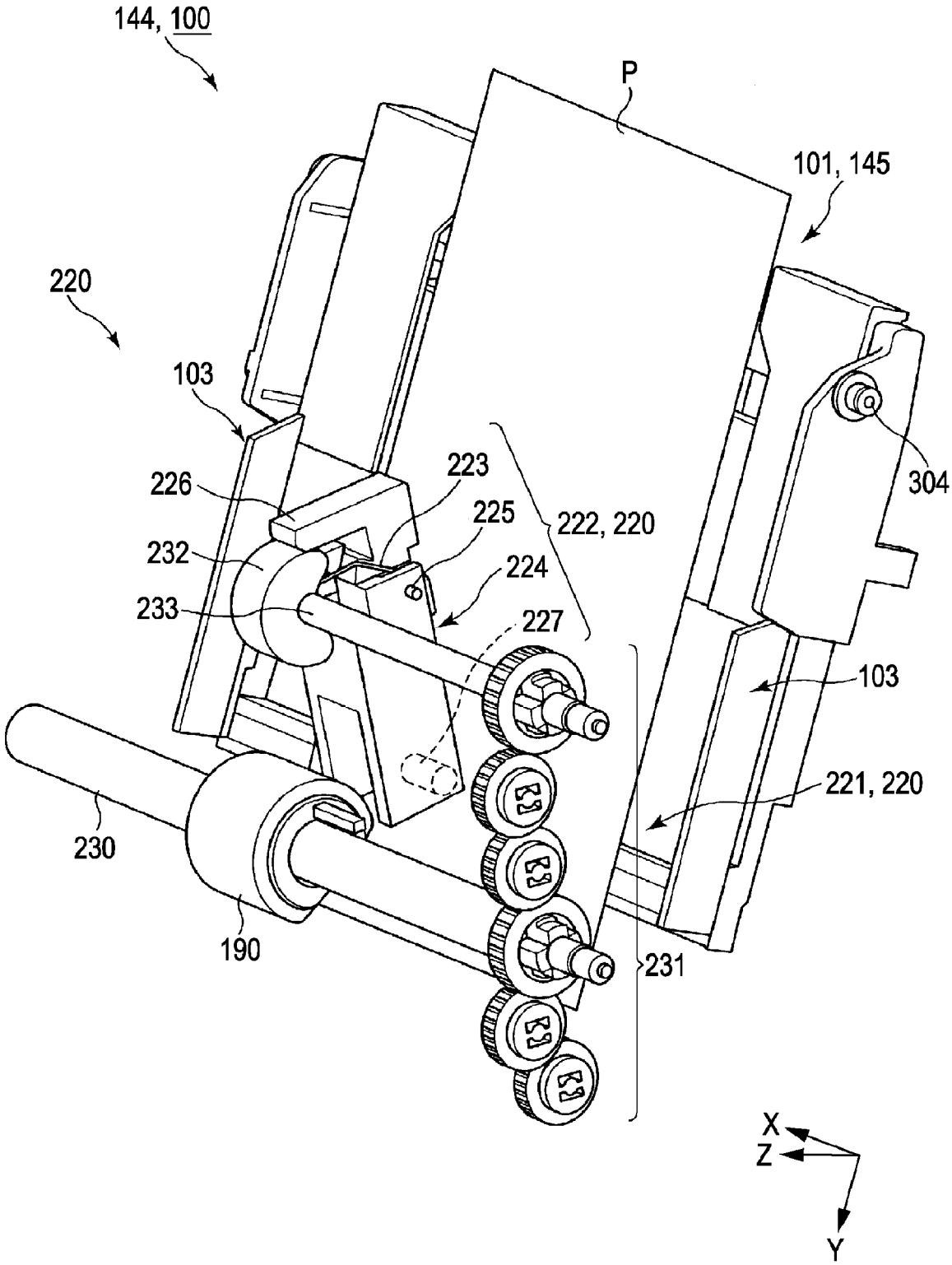
FIG. 2 is a perspective view illustrating a feeding portion according to the invention.
Figure 3:
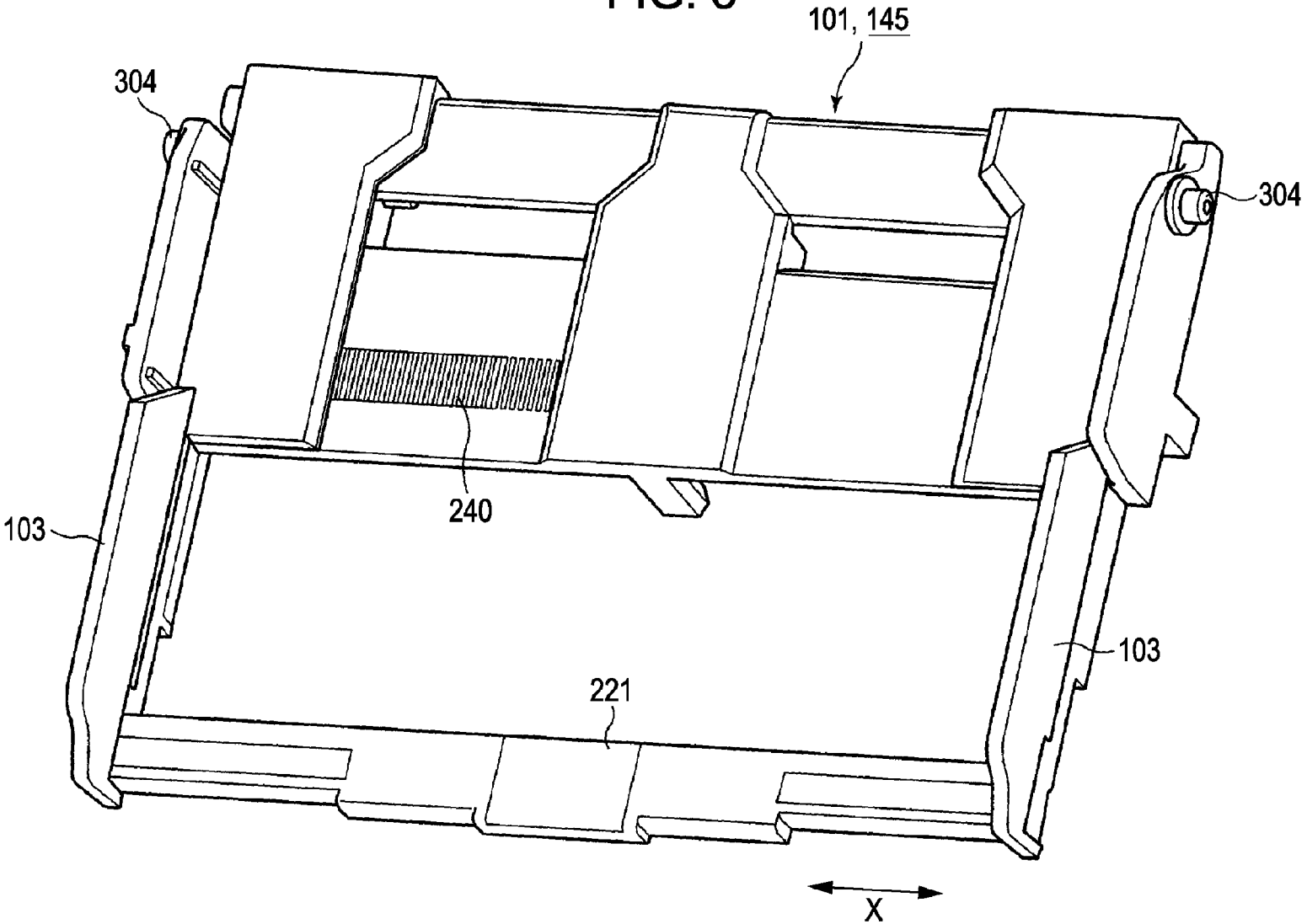
FIG. 3 is a perspective view illustrating a hopper and an edge guide according to the invention.

FIG. 2 is a perspective view illustrating a feeding portion according to the invention, and FIG. 3 is a perspective view illustrating the hopper and the edge guides according to the invention.

As shown in FIGS. 2 and 3, a curve-imparting portion 220 which can impart a curve to the mounted paper P is disposed in the feeding portion 144. The curve-imparting portion 220 has an urging portion 222 disposed on the upper surface side of the hopper 101 and an opening 221 disposed in the hopper 101. The urging portion 222 has an urging lever 224, a curve-inducing roller 227, and a helical torsion spring 223.

Of these elements, the urging lever 224 is disposed in a manner such that it can swing about a lever shaft 225. The curve-inducing roller 227 is supported by an end of the urging lever 224 in a freely pivotable manner. Further, the helical torsion spring 223 is structured in a manner such that the curve-inducing roller 227 urges the urging lever 224 in a direction of approaching the opening 221.

The opening 221 extends in the widthwise direction X of the paper P in the hopper 101. That is, the opening 221 has a width larger than the maximum width of the paper which can be mounted in the hopper 101.

Moreover, a cam follower 226 is formed at the other end of the urging lever 224 in a manner such that it can engage with a cam 232. The cam 232 is disposed about a cam shaft 233 in a pivotable manner. The cam 232 is structured so as to pivot, interlocking with pivot motion of the feeding roller shaft 230 via a gear train mechanism 231. That is, the cam 232 is structured so as to pivot by power of the feeding motor 104.

Further, as shown in FIG. 3, an irregular portion 240 which is concave and convex in the widthwise direction X is provided to the hopper 101. On the other hand, a protruding portion (not shown) engaging with the irregular portion 240 is disposed at the edge guide side. Therefore, when the edge guides 103 and 103 move, the protruding portion can get over the irregular portion 240 while causing vibration of the irregular portion 240. Accordingly, it is possible to create a gap between the paper P and the paper P mounted in the hopper 101. As a result, when aligning side ends of the paper P by closing the edge guides 103 and 103, it is possible to more surely align both ends of the paper P. That is, there is no possibility that side ends of the paper P are not aligned because sheets of the paper P overlapping each other securely adhere to each other.

Figure 4:
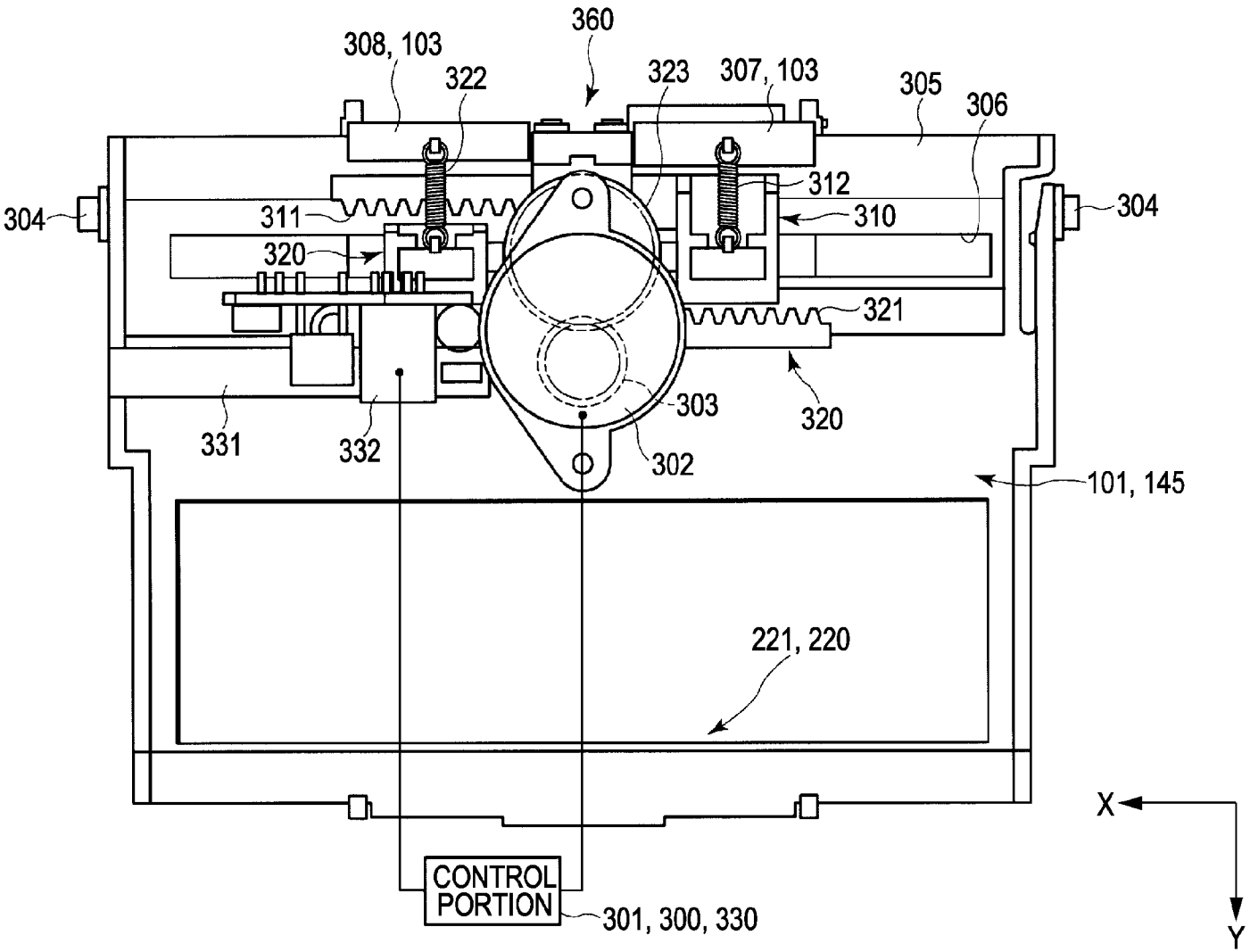
FIG. 4 is a rear view illustrating a mounting portion according to the invention.

FIG. 4 is a rear view illustrating the mounting portion according to the invention.

As shown in FIG. 4, a link mechanism 360 called a locking and pinion mechanism which makes movement of a right side guide 307 and a left side guide 308 which are the edge guides 103 symmetric in a left and right direction is disposed at the back side of the hopper 101. The link mechanism 360 has a first rail engaging portion 310, a second rail engaging portion 320, and a compound pinion gear 323. Of these elements, the first rail engaging portion 310 is disposed so as to engage with the right side guide 307 in a freely movable manner in a Y-axis direction which is the feeding direction. The first rail engaging portion 310 is disposed so as to be in slide contact with the second guide rail portion 306.

In greater detail, an end of a first engaging spring 312 engages with the right side guide 307 and the other end of the first engaging spring 312 engages with the first rail engaging portion 310. With this structure, the right side guide 307 is in slide contact with the first guide rail portion 305 and the first rail engaging portion 310 is urged so as to be brought into slide contact with the second guide rail portion 306. Accordingly, a posture of the right side guide 307 is maintained to extend in the Y-axis direction which perpendicularly intersects an X-axis direction.

In a similar manner, the second rail engaging portion 320 is disposed so as to engage with the left side guide 308 in a freely movable manner in the Y-axis direction. The second rail engaging portion 320 is disposed so as to be in slide contact with the second guide rail portion 306.

In greater detail, an end of the second engaging spring 322 engages with the left side guide 308 and the other end of the second engaging spring 322 engages with the second rail engaging portion 320. With this structure, the left side guide 308 is in slide contact with the first guide rail portion 305 and the second rail engaging portion 320 is urged so as to be brought into slide contact with the second guide rail portion 306. Accordingly, a posture of the left side guide 308 can be maintained to extend in the Y-axis direction which perpendicularly intersects the X-axis direction.

A first locking portion 311 engaging with the compound pinion gear 323 is disposed at the first rail engaging portion 310. In a similar manner, a second locking portion 321 engaging with the compound pinion gear 323 is disposed at the second rail engaging portion 320. Accordingly, movement of the right side guide 307 and movement of the left side guide 308 can be symmetric in the left and right direction.

Here, since postures of the first rail engaging portion 310 and the second rail engaging portion 320 can be maintained, postures of the first locking portion 311 and the second locking portion 321 can be also maintained. That is, movement of the right side guide 307 and movement of the left side guide 308 can be highly symmetric in the left and right direction.

A motor pinion 303 is disposed at a DC motor 302. Further, the motor pinion 303 is disposed so as to engage with the compound pinion 323. Accordingly, it is possible to move the left side guide 307 and the right side guide 308 by power of the DC motor 302.

Further, a paper size determining unit 330 which determines the size of the paper P is disposed in the recording apparatus 100. The paper size determining unit 330 has an encoder sensor 332, a linear scale 331, and a control portion 301.

Of these elements, the encoder sensor 332 is integrally formed with the second rail engaging portion 320. The linear scale 331 is integrally formed with the hopper 101. Accordingly, it is possible to detect a position where the left side guide 308 is positioned.

Here, the right side guide 307 is placed at a position where the right side guide 307 is symmetric with the left side guide 308 in the left and right direction by a link mechanism 360. Accordingly, the control portion 301 can inevitably identify the position of the right side guide 307.

Therefore, the recording apparatus 100 can be structured in a manner such that when a power supply of the recording apparatus 100 is turned on, after the paper P is set in the hopper 101, paper size determination is performed by a recording performing instruction first, and then the recording is performed. The paper size determination unit 330 moves the right side guide 307 and the left side guide 308 which are broadened in the widthwise direction X to a center side by driving the DC motor 302 first. Accordingly, the right side guide 307 and the left side guide 308 contact a right side end and a left side end of the paper P, respectively.

At this time, a determination unit 300 of the control portion 301 determines whether a current value of the DC motor 302 reaches a predetermined threshold value.

Here, "predetermined threshold value" is a value larger than a current value attributable to load when the right side guide 307 and the left side guide 308 simply contact side ends of the paper P. Further, it is a value smaller than a current value attributable to the load at the contact time, i.e. when the right side guide 307 and the right side guide 308 contact both side ends of the paper P of which side ends are aligned.

In the case in which the current value of the DC motor 302 is below a threshold value, the control portion 301 continuously drives the DC motor 302. On the other hand, in the case in which the current value of the DC motor 302 reaches the predetermined threshold value, the control portion 301 suspends the driving of the DC motor 302. That is, if the current value is below the threshold value, since both side ends of the paper P are not aligned, the load is small and it is determined such that the current value is small. On the other hand, in the case in which the current value reaches the threshold value, it is determined such that both side ends of the paper P are already aligned and therefore the right side guide 307 and the left side guide 308 cannot be further moved to the center side.

Next, the position of the left side guide 308 when the current value reaches the threshold value is detected by the encoder sensor 332 and the linear scale 331. Here, as described above, the position of the right side guide 307 is symmetric with the position of the left side guide 308 in the left and right direction. Accordingly, it is possible to detect the size of the paper mounted in the hopper 101.

State when Setting Paper

Subsequently, operation of the curve-imparting portion will be explained.

Figure 5:
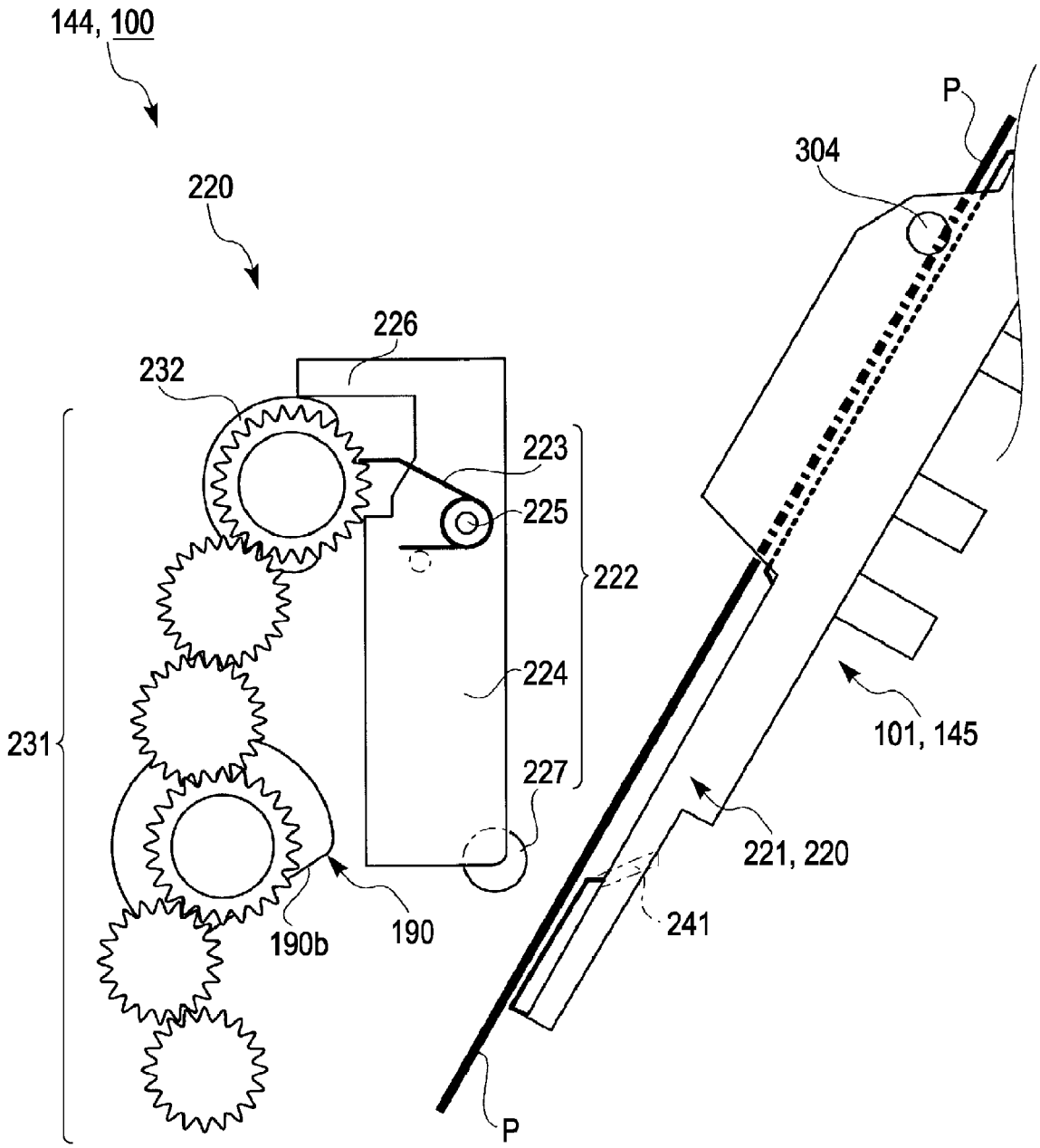
FIG. 5 is a side view illustrating a feeding portion at the time of setting paper, according to the invention.

FIG. 5 is a side view illustrating the feeding portion at the paper setting time according to the invention.

As shown in FIG. 5, when setting the paper, the hopper 101 is in a state in which it is spaced apart from the feeding roller 190. The position of the feeding roller 190 is a reset position.

Here, "reset position" means a posture of the feeding roller 190 which is taken before the beginning of the feeding and after the ending of the feeding and a phase in which an arc portion 190*b* of the feeding roller 190 faces the hopper 101.

The cam follower 226 is in an engaged state with the cam 232. Accordingly, a posture of an urging lever 224 is determined by the cam 232. Therefore, the curve-inducing roller 227 is in a state in which it is spaced apart from the hopper 101.

As a result, a user can easily set the paper P in the hopper 101.

Here, a paper leading end guide inclination portion 241 which inclines with respect to a mounting surface of the hopper 101 is formed at the downstream side of the feeding direction in the opening 221 of the hoper 101. Accordingly, when a user set the paper P, there is no possibility that the leading end of the paper P is provided over the opening 221.

State in which Curve is Imparted to Paper

Figure 6:
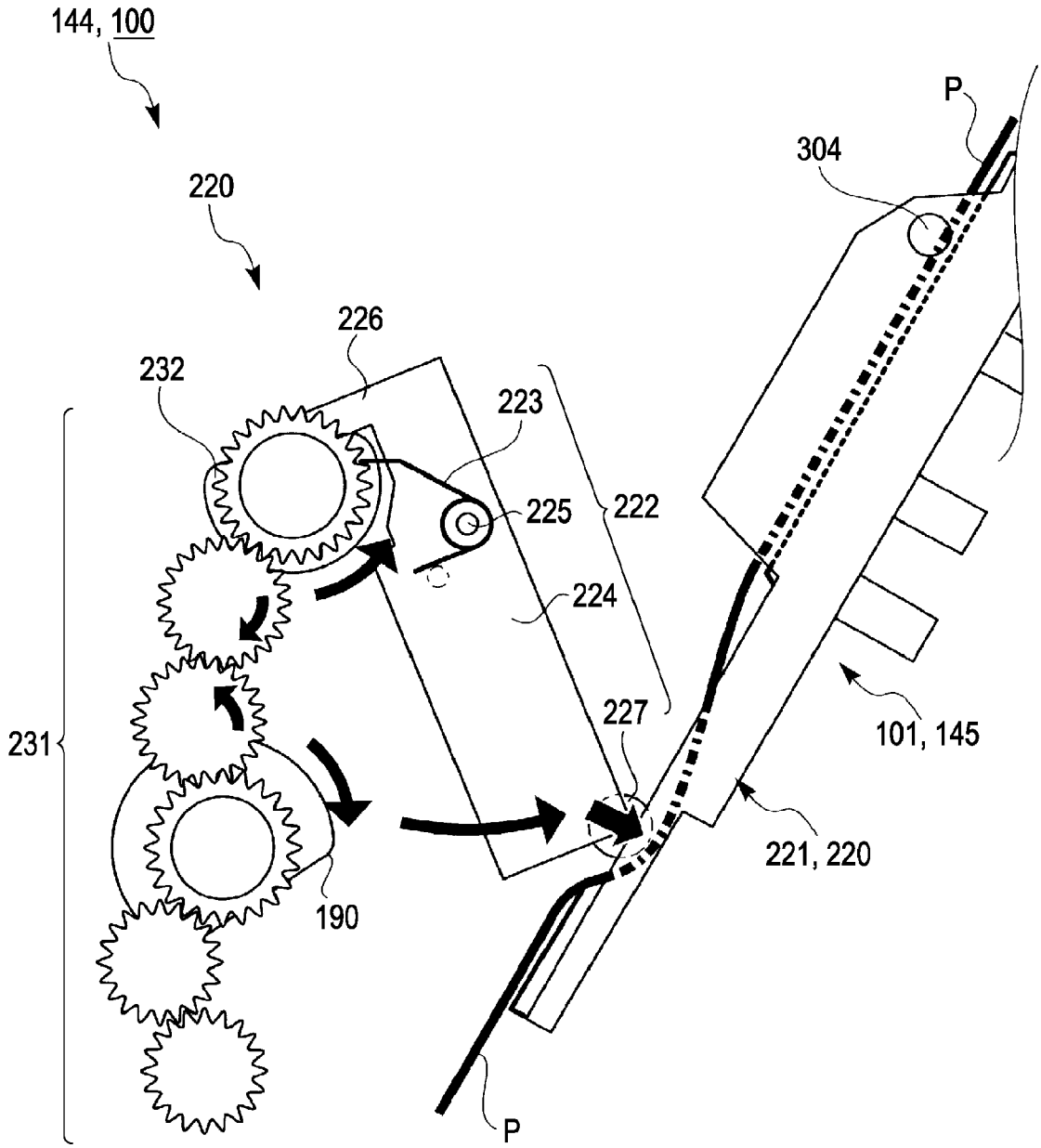
FIG. 6 is a side view illustrating a feeding portion in a state in which a curve is imparted to paper, according to the invention.

FIG. 6 is a side view illustrating the feeding portion in a state in which the curve is imparted to the paper according to the invention.

As shown in FIG. 6, if an instruction for starting a recording is issued after the paper P is set, the curve is imparted to the mounted paper P first. In greater detail, as the feeding motor 104 pivots slightly, the feeding roller 190 slightly pivots in a clockwise direction in the figure. At this time, power is transferred to the cam 232 by the gear train mechanism 231 and the cam 232 pivots slightly in a counterclockwise direction. Thus, engagement of the cam 232 and the cam follower 226 is released.

Accordingly, the urging lever 224 pivots about a lever shaft 225 in the counterclockwise direction by urging force of the helical torsion spring 223. That is, a posture of the urging lever 224 is displaced in a manner such that the curve-inducing roller 227 approaches the opening 221 of the hopper 101. Therefore, the curve-inducing roller 227 pushes and presses the paper P and makes the paper P curve. At this time, since the opening 221 elongates in the widthwise direction X of the paper P, the paper P curves so as to draw an arc when it is viewed from the side.

That is, the paper P is bent in a manner such that the arc can come into the opening 221.

Here, as stiffness of the paper P becomes weaker, the paper P easily curves. As the number of the mounted paper P becomes smaller, the paper P easily curves.

Further, since the curve-inducing roller 227 which contacts the paper P is disposed in a freely pivotable manner, there is no possibility that position precision of the paper P in the feeding direction Y is influenced.

Closed State of Edge Guides

Figure 7:
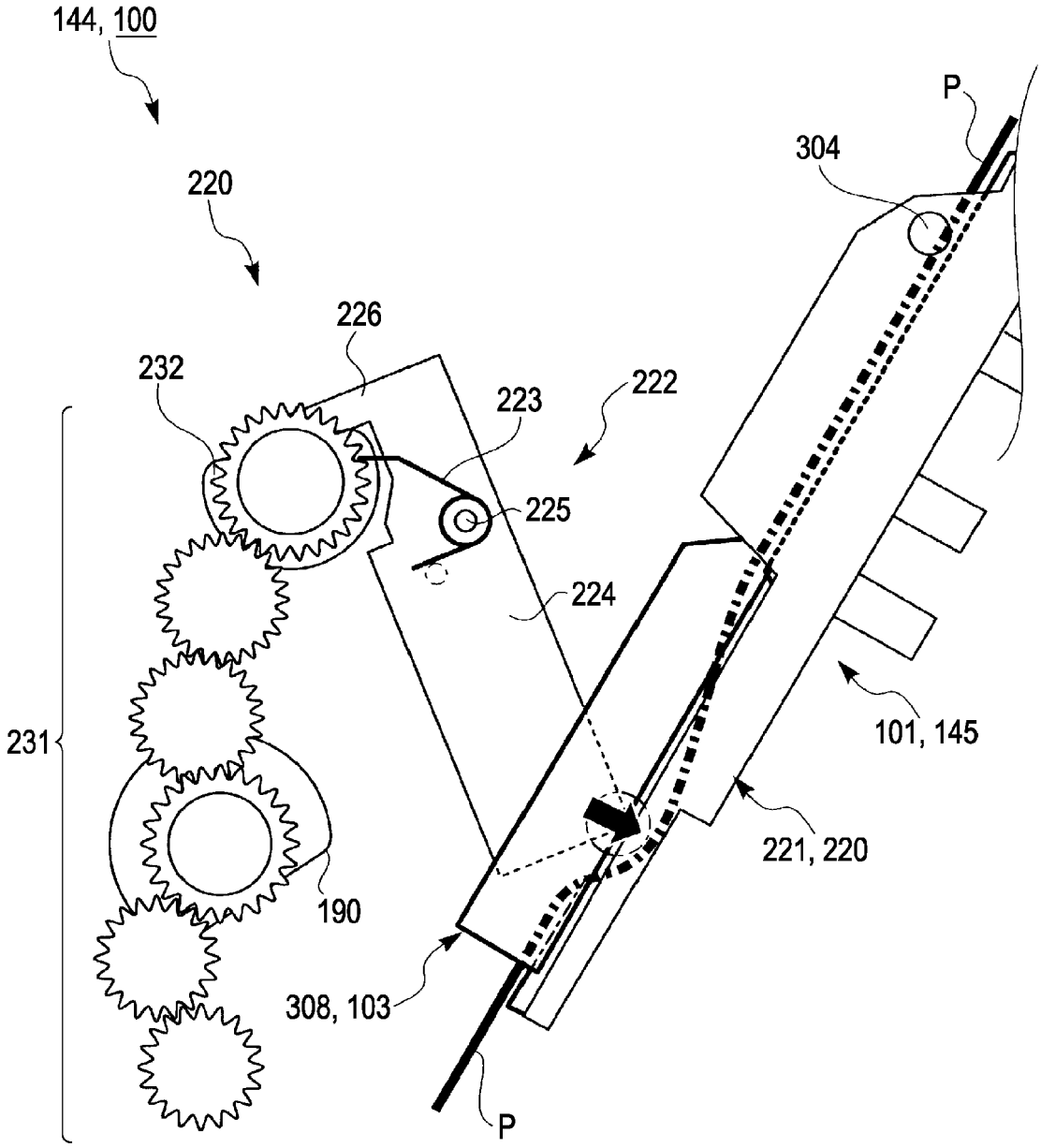
FIG. 7 is a side view illustrating the feeding portion in a state in which the edge guide is closed, according to the invention.

FIG. 7 is a side view illustrating the feeding portion in which the edge guide is in the closed state, according to the invention.

As shown in FIG. 7, in a state in which the paper P is pushed and pressed by the curve-inducing roller 227, the edge guides 103 and 103 move in a closing direction by driving of the DC motor 302. Accordingly, the edge guides 103 and 103 contact both side ends of the paper P. At this time, the control portion 301 is structured so as to drive the DC motor 302 until the current value of the DC motor 302 reaches the predetermined threshold value.

In the case in which the above-mentioned current value does not reach the predetermined threshold value, it is determined such that both side ends of the paper P are not aligned. Therefore, the edge guides 103 and 103 are moved in the closing direction so that both side ends of the paper P are aligned. After that, when the current value reaches the predetermined threshold value, the control portion 301 determines such that both side ends of the paper P are aligned and the edge guides 103 and 103 contact both side ends of the paper P, therefore driving of the DC motor 302 is stopped. That is, it is determined such that it cannot further close the edge guides 103 and 103.

At this time, in the case in which stiffness of the paper P is weak or in the case in which the number of paper P is small, the paper P curves in a direction which perpendicularly intersects the moving direction of the edge guides 103 and 103. In such a case, since the paper P is pushed and pressed by the edge guides 103 and 103, there is no possibility that a middle portion of the paper P in the widthwise direction X floats up, making a curve in the widthwise direction X. That is, the paper P curving in the perpendicularly intersecting direction can resist the force which causes the edge guides 103 and 103 to be closed.

Further, in the case in which stiffness of the paper P is weak, there can be a case in which the paper P does not curve by the urging force of the helical torsion spring 223. In such a case, the paper P can resist the force which causes the edge guides 103 and 103 to be closed by strong stiffness without curving.

Further, in the case in which the number of paper P is large, there can be a case in which the paper P does not curve by the urging force of the helical torsion spring 223.

In a similar manner with such a case, the paper P can resist the force which causes the edge guides 103 and 103 to be closed by the large number of paper P without the curving.

Furthermore, it is desirable that the edge guides 103 and 103 are structured so as to contact the entire curved portion of the paper P. In such a case, the curved paper P can surely resist the force which causes the edge guides 103 and 103 to be closed.

State in which Curve-imparting is Released

Figure 8:
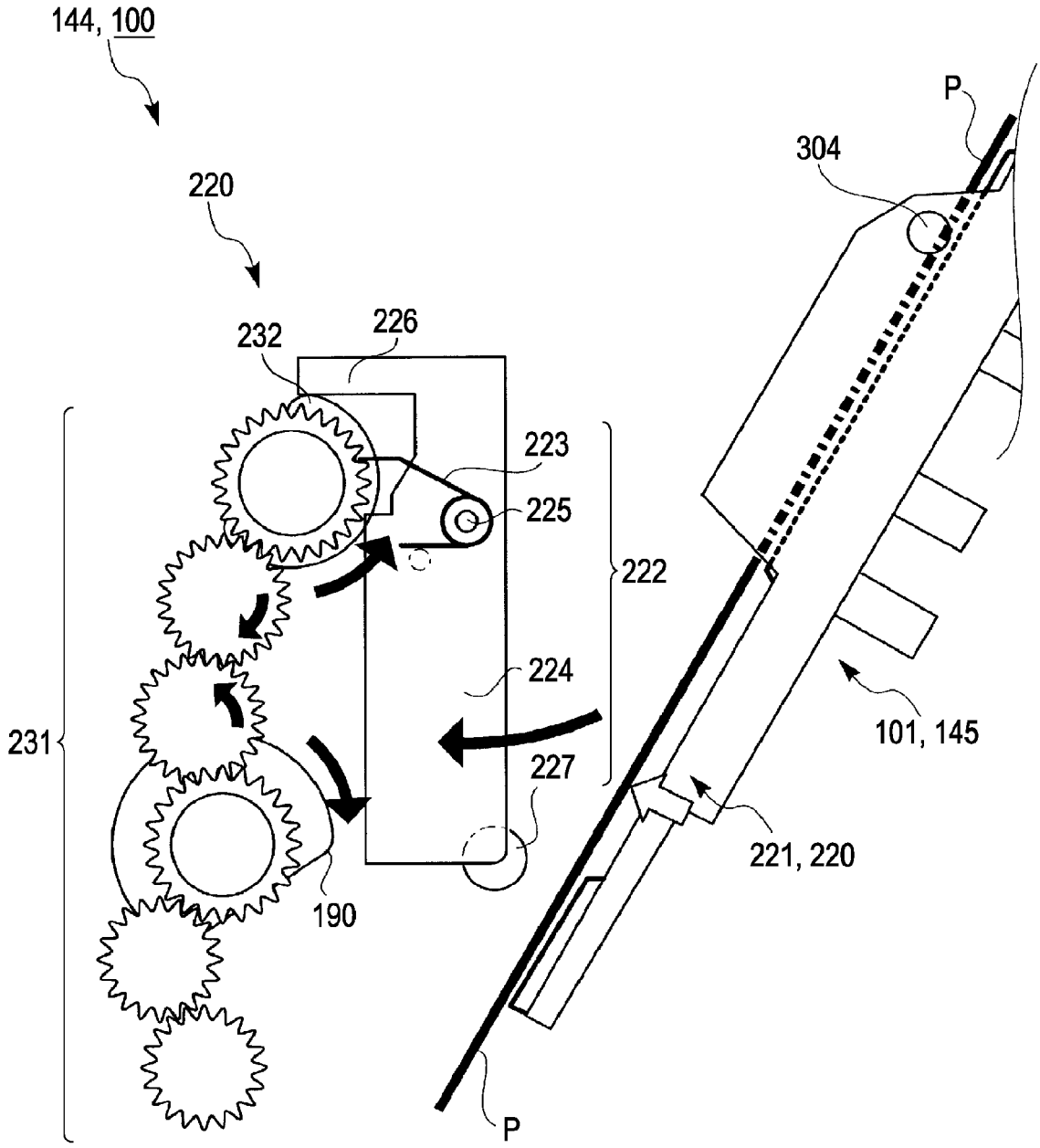
FIG. 8 is a side view illustrating the feeding portion in a state in which the curve imparted to the paper is released, according to the invention.

FIG. 8 is a side view illustrating the feeding portion in a state in which the curve-imparting to the paper is released.

As shown in FIG. 8, after the edge guides 103 and 103 are closed and both side ends of the paper P are aligned, there is no need to continuously impart the curve to the paper P. Accordingly, the curve-imparting to the paper P is released. In greater detail, the feeding motor 104 is slightly driven, the feeding roller 190 pivots slightly in the clockwise direction in the figure. At this time, power is transferred to the cam 232 by the gear train mechanism 231. Accordingly, the cam 232 pivots slightly in the counterclockwise direction in the figure and engages with the cam follower 226.

Therefore, the posture of the urging lever 224 is displaced in a manner such that the curve-inducing roller 227 departs from the opening 221 of the hopper 101. As a result, the curve-inducing roller 227 departs from the paper P and the curve-imparting state to the paper P is released.

At this time, the DC motor 302 is driven and therefore the edge guides 103 and 103 move slightly in an opening direction.

Accordingly, when feeding a next paper P, it is possible to prevent friction occurs between the edge guides 103 and 103 and both side ends of the paper P, respectively.

Further, it is desirable that the edge guides 103 and 103 are structured so as to move in the opening direction of the edge guides after the curve-inducing roller 227 departs from the paper P. In such a case, when the curve-inducing roller 227 departs from the paper P, there is no possibility that the posture-position of the paper P is displaced.

After that, the hopper 101 moves so as to approach the feeding roller 190 (called hopper-up). At this time, the urging lever 224 of the urging portion 222 and the curve-inducing roller 227 are structured so as not to be in contact with the paper P. Therefore, as the feeding roller 190 pivots, the paper P mounted at the uppermost position of the hopper 101 is picked up and fed to the downstream side of the feeding direction.

As described above, a recording is performed with respect to the fed paper P by the recording portion 143. After that, the hopper 101 moves in a direction of departing from the feeding roller 190 (called hopper-down). Therefore, the hopper falls to the state shown in FIG. 5.

Further, in this embodiment, although it is structured in a manner such that the edge guides are disposed at left and right sides and the paper is aligned at a middle portion of the widthwise direction, but it is not limited to such a structure. It may be structured in a manner such that only a single edge guide which is movable is provided and the paper is got closer to either the left side or the right side.

The feeding portion 144 serving as the feeding device of this embodiment includes the hopper 101 serving as the mounting portion 145, which mounts the paper P which is an example of the medium, thereon, the feeding roller 190 which feeds the mounted paper P, the edge guides 103 and 103 which move in the widthwise direction X traversing the feeding direction Y of the mounted paper P and which aligns both sides of the mounted paper P, and the curve-imparting portion 220 which imparts the curve to the paper P in the direction which intersects the moving direction of the edge guides 103 and 103.

In this embodiment, the edge guides 103 and 103 have a structure in which they are automatically moved by driving of the DC motor 302 which is an example of the motor.

Further, in this embodiment, when aligning the paper P by moving at least the edge guides 103 and 103, the curve is imparted by the curve-imparting portion 220. When the paper P is fed by the feeding roller 190, the curve imparted by the curve-imparting portion 220 is released.

In this embodiment, the curve-imparting portion 220 has a structure in which it interlocks with movements of the edge guides 103 and 103.

Still further, in this embodiment, the curve-imparting portion 220 has the opening 221 extending in the widthwise direction X at a portion of the mounting portion 145 and the urging portion 222 which can urge the mounted paper P from the upper side to the lower side in a stacking direction Z of the paper P at a position which faces the opening 221.

The recording apparatus 100 of this embodiment includes the feeding portion 144 which feeds the paper P which is an example of the mounted recording medium, and the recording portion 143 which performs the recording on the paper P fed from the feeding roller 144 by the recording head 106.

Another Embodiment

Figure 9:
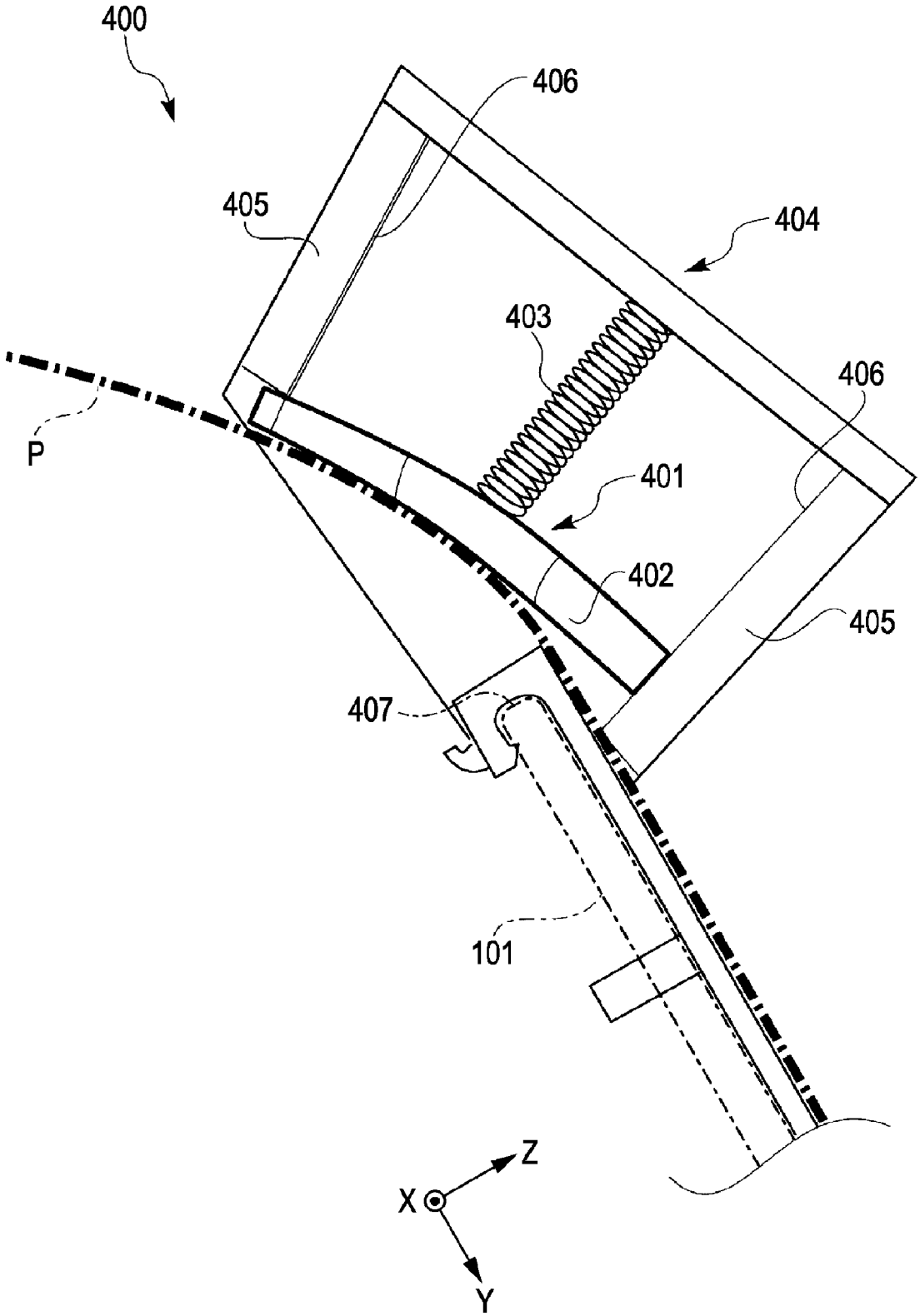
FIG. 9 is a side view illustrating a curve-imparting portion according to another embodiment.
Figure 10:
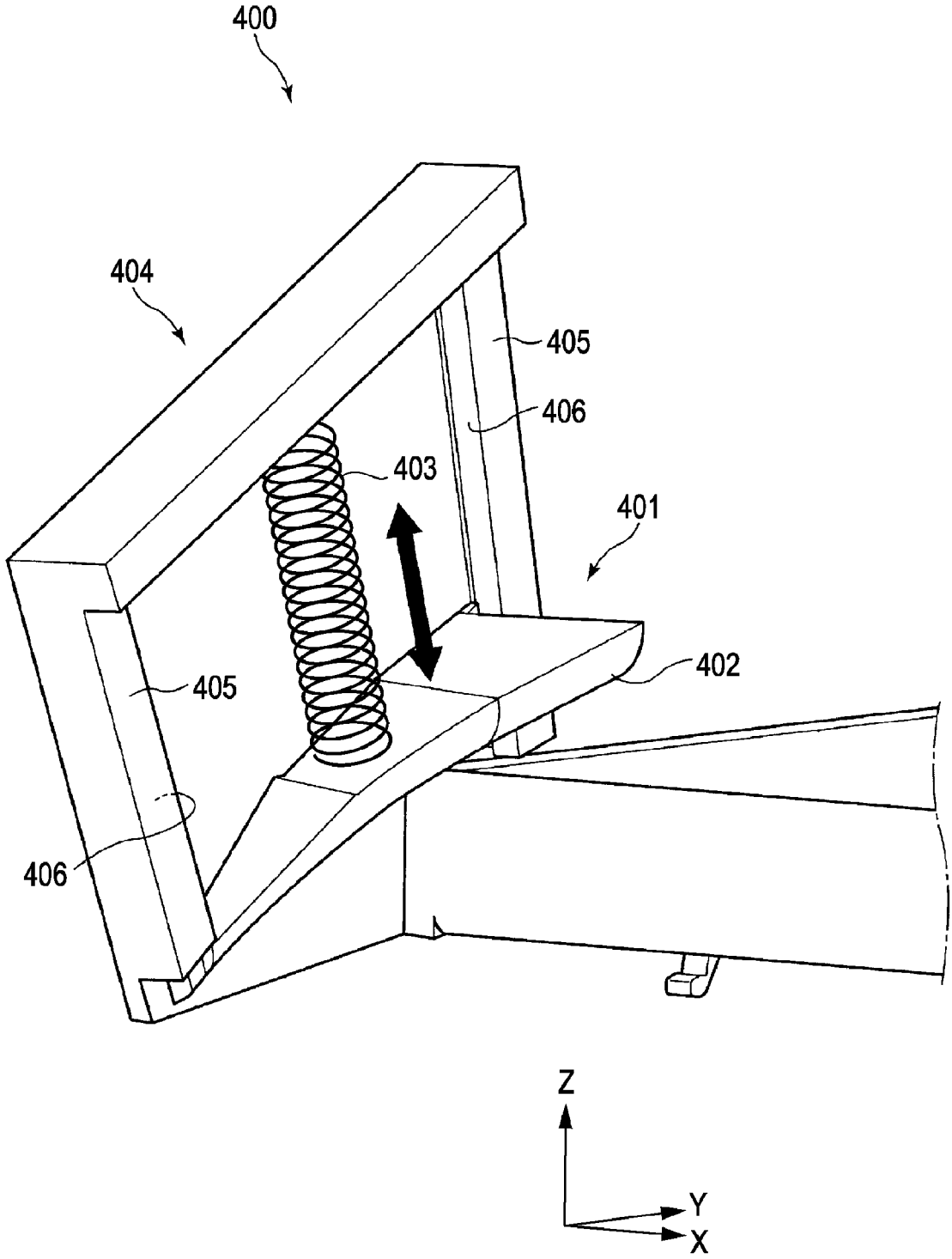
FIG. 10 is an upward perspective view illustrating the curve-imparting portion, according to the above-mentioned another embodiment.
Figure 11:
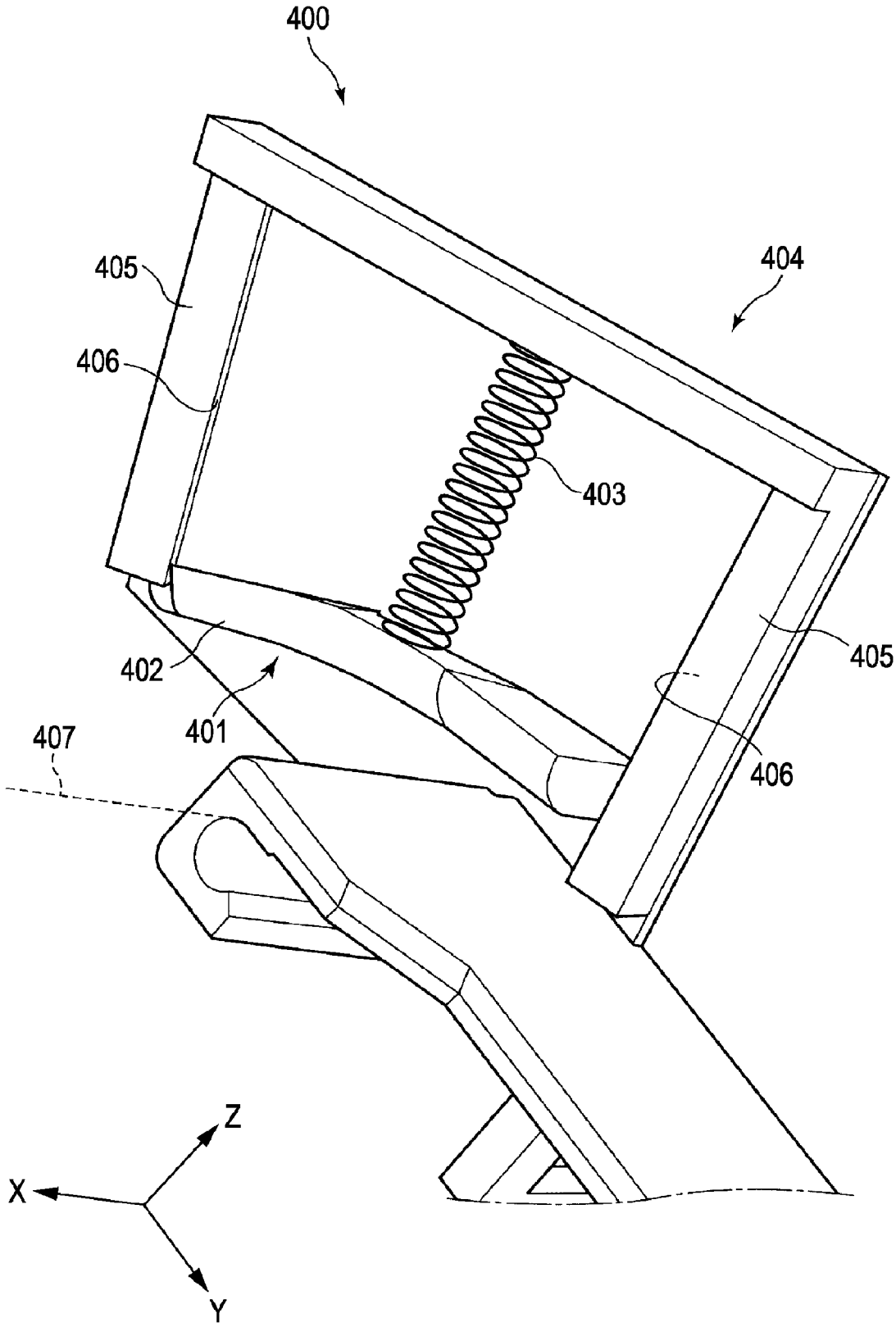
FIG. 11 is a downward perspective view illustrating the curve-imparting portion, according to the above-mentioned another embodiment.
Figure 12:
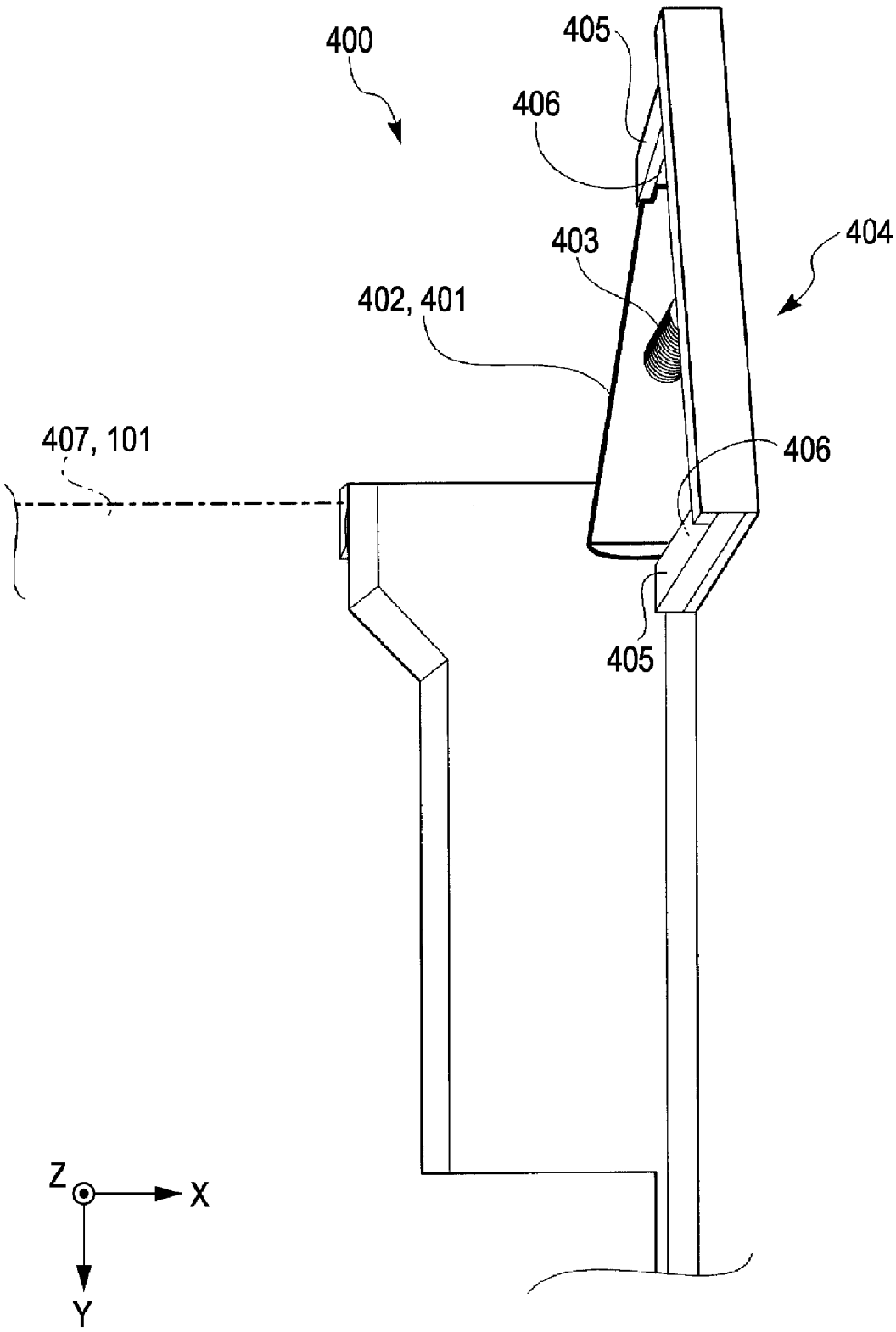
FIG. 12 is a plan view illustrating the curve-imparting portion, according to the above-mentioned another embodiment.

FIG. 9 is a side view illustrating a curve-imparting portion according to another embodiment. FIG. 10 is an upward perspective view illustrating a curve-imparting portion, according to the above-mentioned another embodiment. Further, FIG. 11 is a downward perspective view illustrating the curve-imparting portion, according to the above-mentioned another embodiment. FIG. 12 is a plan view illustrating the curve-imparting portion, according to the above-mentioned another embodiment.

Further, each of the curve-imparting portion and the edge guides are disposed at both sides in the widthwise direction in the form of a pair. However, since they are symmetric in the left and right direction, the right side is explained but explanation of the left side will be omitted.

As shown in FIGS. 9 to 12, the curve-imparting portion 400 according to the above-mentioned another embodiment has a pushing guide 401 and a helical compression spring 403. Of these elements, the pushing guide 401 is disposed at a position which faces an upstream end 407 of the hopper 101 in the feeding direction Y. The pushing guide 401 is disposed in a manner such that it is guided into trench portions 406 and 406 disposed at the edge guides 404, and is movable in the stacking direction Z of the paper P mounted in the hopper 101.

In greater detail, the pushing guide 410 is disposed so as to be displaced toward the downstream side of the feeding direction as it progresses toward a lower side of the stacking direction. In addition, the pushing guide 401 has a posture in which it inclines with respect to the mounting surface of the hopper 101 in a manner such that the upstream side of the feeding direction becomes the lower side of the stacking direction. An end of the helical compression spring 403 engages with the edge guide 404 and the other end engages with the pushing guide 401. The helical compression spring 403 is disposed so as to urge the pushing guide 401 in a direction of approaching the mounting surface of the hopper 101.

As for the pushing guide 401, at an inner side of the edge guide 404, a tapered portion 402 which inclines in the moving direction of the edge guides 404 is disposed. The tapered portion 402 is structured in a manner such that the downstream side of the feeding direction is an inner side of the edge guide 404 than the upstream side.

The inside surface of the edge guide 404 is provided with a guide surface 405 which contacts and aligns the side end of the paper P with high precision.

Other members are the same as in the above-mentioned embodiment and therefore like elements are referenced by like numbers and description thereof will be omitted.

Next, operation of the curve-imparting portion 400 according to the above-mentioned another embodiment will be described.

State when Setting a Small Number of Paper

Figure 13:
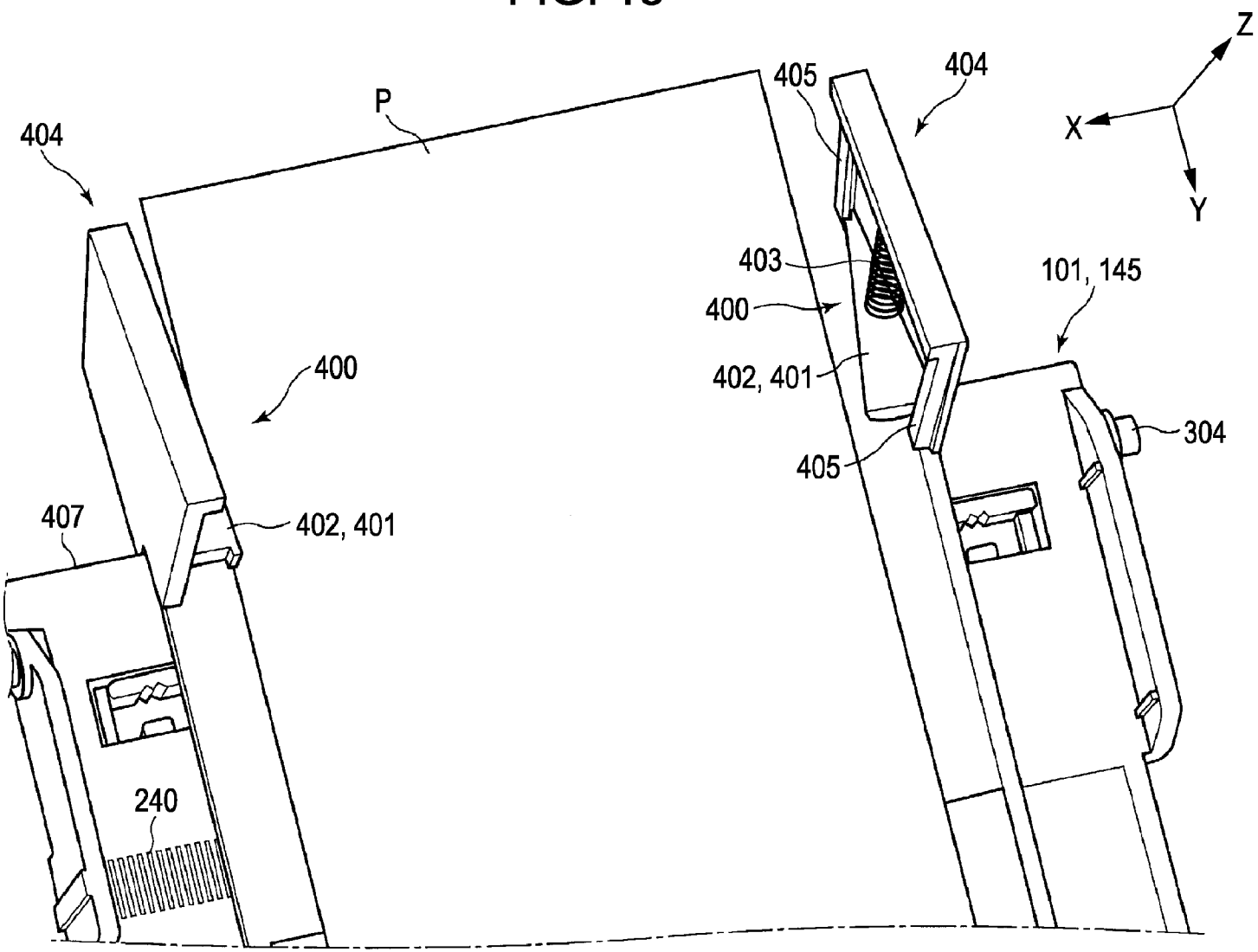
FIG. 13 is a perspective view illustrating a feeding portion at the time of setting paper, according to the above-mentioned another embodiment (a small number of sheets).

FIG. 13 is a perspective view illustrating the feeding portion when setting a small number of paper according to the above-mentioned another embodiment.

As shown in FIG. 13, when a user sets the paper P in the hopper 101, the edge guides 404 and 404 are in the open state in which they are broadened in the widthwise direction X. Accordingly, the user can easily set the paper P in the hopper 101.

The State in which the Edge Guides are Closed

Figure 14:
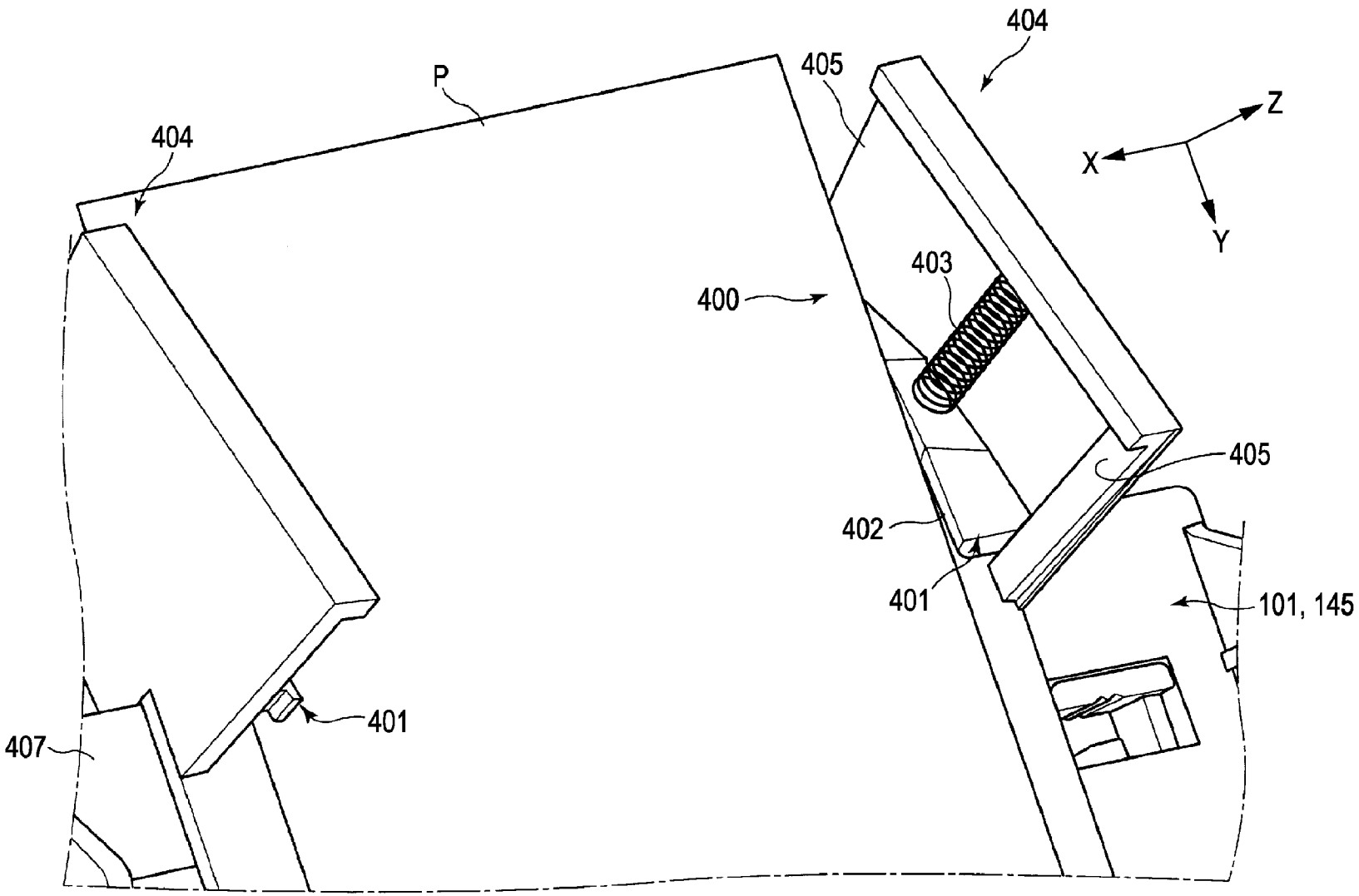
FIG. 14 is a perspective view illustrating the feeding portion in which the edge guide is closed (a small number of sheets).

FIG. 14 is a perspective view illustrating the feeding portion in the middle of closing the edge guides.

As shown in FIG. 14, if the edge guides 404 and 404 are moved in a closing direction (that is, if the edge guides 404 and 404 are moved inward in the widthwise direction) from the state of FIG. 13, the downstream side portions in the feeding direction in the tapered portions 402 and 402 disposed at an inner side of the pushing guides 401 and 401, respectively, contact both side ends of the paper P, respectively.

Here, "downstream side portion in the feeding direction in the tapered portion" means a portion at the downstream side which is opposite to the upstream side of each of the tapered portions 402 and 402. That is, it is not limited to the downstream end of each of the tapered portions 402 and 402.

State in which Edge Guides are Closed

Figure 15:
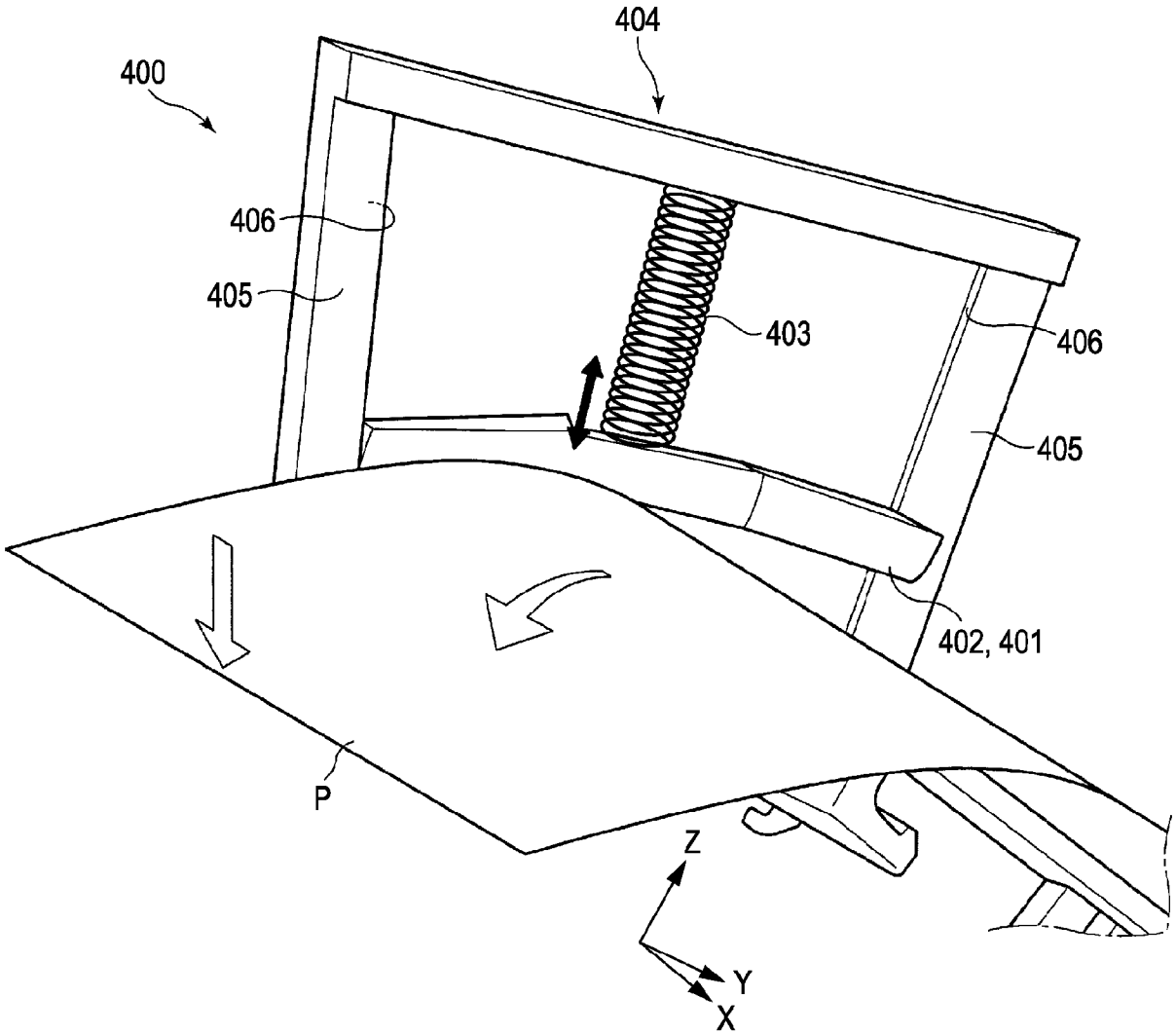
FIG. 15 is a perspective view illustrating the feeding portion in which the curve is imparted to the paper (a small number of sheets).

FIG. 15 is a perspective view illustrating the feeding portion in a state in which the curve is imparted to the paper, in which illustration of the hopper is omitted.

As shown in FIG. 15, if the edge guides 404 and 404 are closed from the state of FIG. 14, the curve is imparted to the paper P disposed at a more upstream side than the upstream end 407 on the hopper 101 by the pushing member. In greater detail, if the edge guides 404 and 404 are closed, the contact positions between the tapered portions 402 and 402 and the side ends of the paper P are displaced toward the upstream side from the downstream side of the feeding direction. At this time, the tapered portions 402 and 402 incline with respect to the mounting surface of the hopper 101 in a manner such that the upstream side of the feeding direction becomes the lower side of the stacking direction as described above.

Accordingly, as the contact positions gradually move toward the upstream side, it is possible to make the upstream side of the paper P curve toward the lower side of the stacking direction. Therefore, the upstream side of the paper P is guided by the tapered portions 402 and 402 and progresses to the underside of the pushing member in the stacking direction. Further, if the edge guides 404 and 404 are closed, both side ends of the curved paper P contact the guide surfaces 405 and 405 which are inside surfaces of the edge guides 404 and 404. At this time, since the current value of the DC motor 302 reaches the predetermined threshold value, operation of closing the edge guides 404 and 404 is stopped. As a result, it is possible to align both side ends of the paper P with high precision. After that, in a similar manner with the above-mentioned embodiment, the edge guides 404 and 404 are slightly open and feeding of the paper P begins.

The contact positions may gradually move toward to the downstream side from the upstream side. In such a case, it is easy to impart the curve to the paper.

State in which the Number Max of Paper is Set and Edge Guides are Closed

Figure 16:
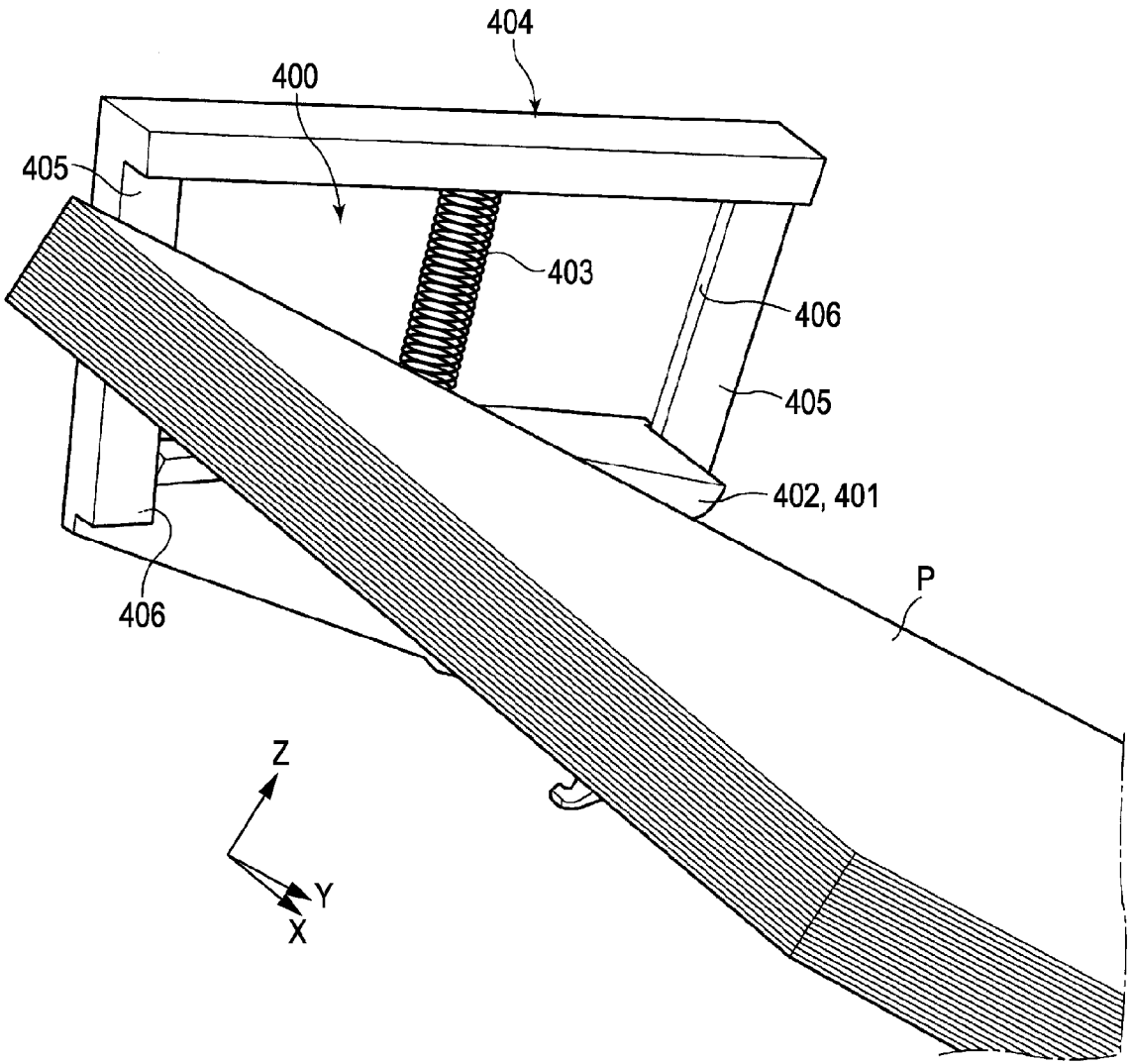
FIG. 16 is a perspective view illustrating the feeding portion in which the edge guide is closed (Max sheets)

FIG. 16 is a perspective view illustrating the feeding portion in the middle of closing the edge guides when the number Max of paper is mounted.

Here, "the number Max" means the maximum number of paper which can be mounted in the hopper.

As shown in FIG. 16, in a state in which the number Max of paper P is mounted in the hopper 101, if the edge guides 404 and 404 are moved in a closing direction, like the case of the small number of paper, downstream side portions in the feeding direction in the tapered portions 402 and 402 disposed at an inner side of the pushing guides 401 and 401 contact both side ends of the paper P.

State in which the Number Max of Paper is Set and Edge Guides are Closed

Figure 17:
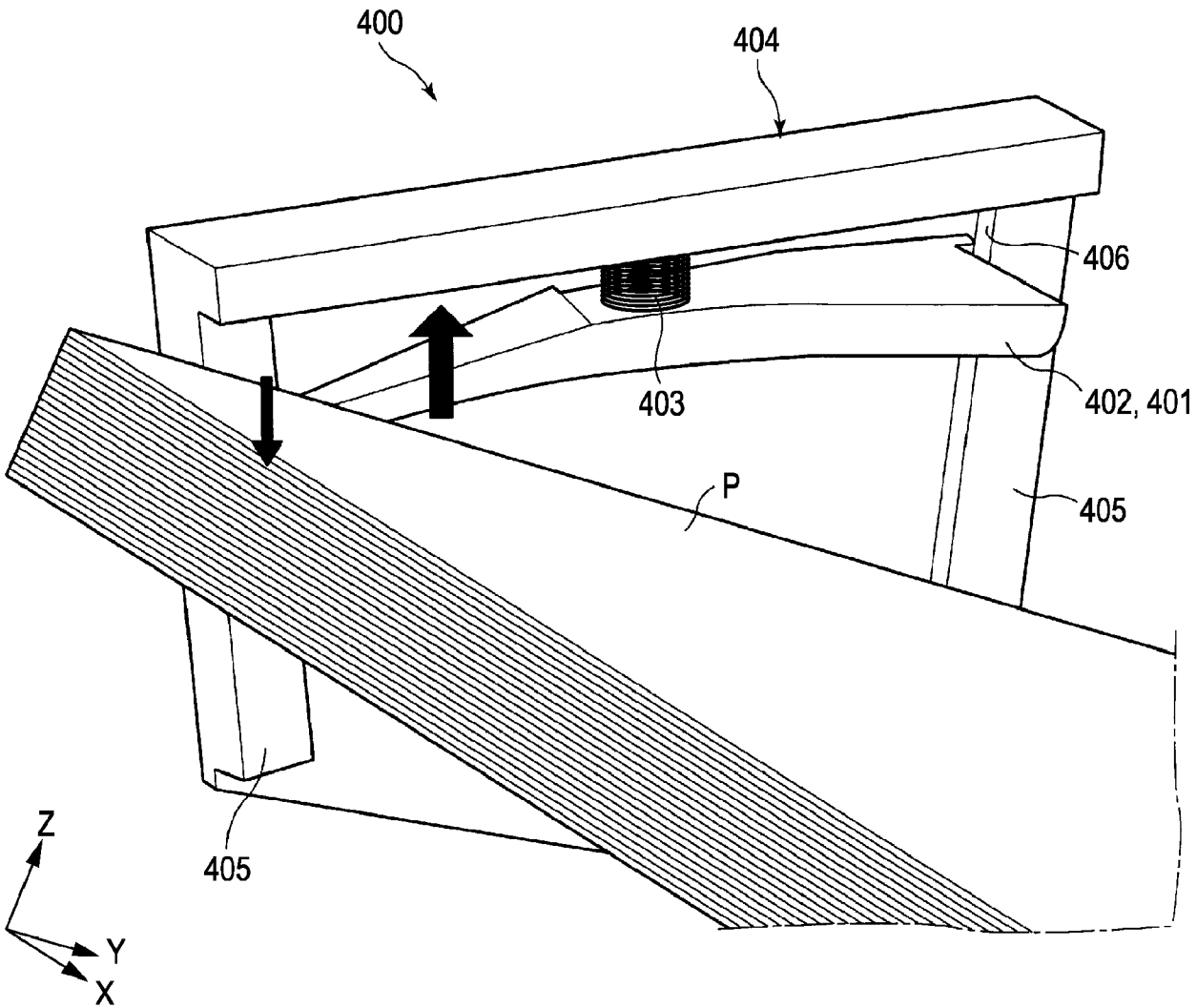
FIG. 17 is a perspective view illustrating the feeding portion in a state in which the edge guide is closed (Max sheets).

FIG. 17 is a perspective view illustrating the feeding portion in a state in which the number Max of paper is mounted and the edge guides are closed.

As shown in FIG. 17, if the edge guides 404 and 404 are further moved in the closing direction from the state of FIG. 16, since the number of paper P is large, it is hard to make the paper P curve. Therefore, the edge guides 404 and 404 are gradually closed and the contact positions between the tapered portions 402 and 402 and the side ends of the paper P are displaced from the downstream side to the upstream side of the feeding direction.

Further, whether the paper curves depends on stiffness of the paper and the number of mounted paper. That is, although the number of the mounted paper is not Max, if the number is relatively large, it is hard to make the paper curve.

Here, in the case in which the urging force of the helical compression spring 403, which is need to make the paper P curve, is weak, the helical compression spring 403 is compressed rather than the paper P curves, and the pushing guides 401 and 401 are moved to the upper side of the stacking direction. Therefore, the guide surfaces 405 and 405 and the side ends of the paper P contact each other. At this time, since the current value of the DC motor 302 reaches the predetermined threshold value, operation of closing the edge guides 404 and 404 is stopped. As a result, it is possible to align both side ends of the paper P with high precision. After that, like the above-mentioned embodiment, feeding of the paper P begins as the edge guides 404 and 404 are slightly open.

In the feeding portion 144 serving as the feeding device according to the above-mentioned another embodiment, the curve-imparting portion 400 is disposed at an inner side of the edge guides 404 and 404 in a movable manner along with movement of the edge guides 404 and 404. The curve-imparting portion 400 includes the pushing guides 401 and 401 serving as the moving portion which is movable in the stacking direction Z of the paper P at the position which faces the upstream end portion of the mounting portion 145 in the feeding direction, and the helical compression spring 403 serving as the urging unit which urges the pushing guides 401 and 401 toward the mounting portion side. The pushing guides 401 and 401 have tapered portions 402 and 402, respectively, which are disposed at an inner side of the pushing guides 401 and 401 and which taper up in the stacking direction of the paper P as it directs inward in the moving direction of the edge guides 404 and 404.

The postures of the tapered portions 402 and 402 incline with respect to the feeding direction Y.

In the above-mentioned embodiment, the pushing guides and the helical compression spring are used as the curve-imparting portion, but the structure of the curve-imparting portion is not limited thereto. For example, it may have a structure in which a paper support is disposed at the upstream side the hopper in the feeding direction and the posture of the paper support inclines with respect to the posture of the hopper, so that the curve is imparted to the paper in a direction which intersects the moving direction of the edge guides.

In the feeding device of the above-mentioned another embodiment, the mounting portion has the hopper which can approach and depart from the feeding roller and the paper support serving as a medium support disposed at the upper-stream side of the feeding direction than the hopper. The curve-imparting portion has a structure of imparting the curve to the medium in a direction which intersects the moving direction of the edge guides by changing the posture of the paper support with respect to the posture of the hopper.

The invention is not limited to the above-mentioned embodiments but various kinds of alterations can be made within the scope of the invention described in claims and it is obvious that the alternations fall into the scope of the invention.

What is claimed is:

1. A feeding device comprising:

a mounting portion which mounts media thereon;

a feeding roller which feeds the mounted media;

an edge-guide which moves in a widthwise direction of the mounted media which traverses to a feeding direction of the mounted media and aligns both sides of the mounted media; and a curve-imparting portion which selectively imparts a curve to the mounted media in a direction which intersects a moving direction of the edge-guide according to a cam which causes the curve-imparting portion to move towards or away from the mounting portion on which the media is mounted so that the curve-imparting portion is moved towards the mounted media and a curve is imparted to the mounted media when the edge-guide is being traversed in the feeding direction so as to properly align the mounted media, while the curve-imparting portion is moved away from the mounting portion on which the media is mounted and the curve is released after the edge-guide stops moving and the mounted media is properly aligned.

2. The feeding device according to claim 1, wherein the edge-guide has a structure in which the edge-guide is automatically moved by driving of a motor.

3. The feeding device according to claim 1, wherein the curve-imparting portion interlocks with movement of the edge-guide.

4. The feeding device according to claim 1, wherein the curve-imparting portion comprises:

an opening which is formed at a portion of the mounting portion and which extends in the widthwise direction; and an urging portion which urges the mounted media in a direction from an upper side to a lower side of the media, which are stacked, at a position which faces the opening.

5. The feeding device according to claim 1, wherein the curve-imparting portion comprises:

a moving portion which is disposed at an inner side of the edge-guide in a movable manner along with movement of the edge-guide and which is capable of moving in a stacking direction of the media at a position facing an upstream end of the feeding direction of the mounting portion;

an urging unit which urges the moving portion toward the mounting portion, wherein the moving portion has a tapered portion which is disposed at an inner side of the moving portion, and tapers up in the stacking direction of the media as the tapered portion directs the media inward in the moving portion with respect to the moving direction of the edge-guide.

6. The feeding device according to claim 1, wherein the mounting portion comprises:

a hopper which can approach and depart from the feeding roller; and a medium support portion disposed at an upstream side of the hopper in the feeding direction, wherein the curve-imparting portion can impart the curve to the media by displacing a posture of the medium support portion so as to face a posture of the hopper.

7. A recording apparatus comprising:

a feeding portion which feeds a recording object which is mounted; and a recording portion which causes a recording head to perform a recording on the recording object which is fed from the feeding portion, wherein the feeding portion includes the feeding device according to claim 1.

* * * * *